United States Patent [19]

Kamp

[11] 4,041,684

[45] Aug. 16, 1977

[54] DEVICE FOR AUTOMATICALLY JOINING A THREAD FOR SPINNING

[75] Inventor: Heinz Kamp, Rickelrath, Germany

[73] Assignee: W. Schlafhorst & Co., Monchengladbach, Germany

[21] Appl. No.: 724,925

[22] Filed: Sept. 20, 1976

[30] Foreign Application Priority Data

Sept. 18, 1975 Germany ..... 2541589

[51] Int. Cl.[2] ..... D01H 15/00

[52] U.S. Cl. ..... 57/34 R; 57/58.89

[58] Field of Search ..... 57/34 R, 58.89–58.95

[56] References Cited

U.S. PATENT DOCUMENTS

| | | | |
|---|---|---|---|
| 3,695,017 | 10/1972 | Hori et al. | 57/34 R |
| 3,810,352 | 5/1974 | Miyazaki et al. | 57/34 R |
| 3,815,347 | 6/1974 | Nemec et al. | 57/34 R |
| 3,924,393 | 12/1975 | Stablecker et al. | 57/34 R |
| 3,924,394 | 12/1975 | Stablecker et al. | 57/34 R |
| 3,962,855 | 6/1976 | Stablecker | 57/34 R |

*Primary Examiner*—Richard C. Queisser
*Assistant Examiner*—Charles Gorenstein
*Attorney, Agent, or Firm*—Herbert L. Lerner

[57] ABSTRACT

Device for automatically starting or resuming operation by joining a thread for spinning in an open-end spinning machine, the device having a pivotable bent suction tube for seizing a thread end located on a take-up coil, the suction tube being formed at the inside of the bend thereof with a longitudinally extending slit for passage therethrough of a sucked-in thread, includes a pivot bearing for the pivotable suction tube, a negative pressure supply line connected to the suction tube at the pivot bearing, a transfer arm connected at one end thereof to the suction tube at the pivot bearing, and thread gripping means mounted for movement from the pivot bearing to the free end of said transfer arm for transfering a thread end from the pivot bearing to the free end of the transfer arm.

10 Claims, 7 Drawing Figures

DEVICE FOR AUTOMATICALLY JOINING A THREAD FOR SPINNING

The invention relates to a device for automatically starting a spinning operation by joining a thread in an open-end spinning machine and, more particularly, to such a device having a pivotable bent suction tube for seizing the thread end located on the takeup coil, this suction tube being formed at the inside of the bend thereof with a longitudinally extending slit for passage of a sucked-in thread therethrough.

The joining or piecing of a broken thread in an open-end spinning machine or the initial joining or start-up demands great skill and dexterity. The thread end must be searched for on the take-up coil of the winding device, threaded over encircling or looping devices, plucked out or sharpened to a point and finally fed into the spining rotor. When inserting the thread end into the rotor, the feed of the fiber sliver must be set in operation. A qualitatively gut joining or piecing does not succeed, for the most part, at the first attempt. The joining or piecing operation is therefore also time-consuming. Reliable and rapidly operating automatic joining or piecing devices have not become known heretofore.

The invention seeks to provide corrective measures. Accordingly, it is an object of the invention to provide a device for automatically joining or piecing a thread for spinning which affords trouble-free operation and simultaneously improves the quality of the joining or piecing location in the thread of the so-called "joiner" or "piecer".

With the foregoing and other objects in view, there is provided in accordance with the invention a device for automatically starting or resuming operation by joining a thread for spinning in an open-end spinning machine, the device hving a pivotable bent suction tube for seizing a thread end located on a take-up coil, the suction tube being formed at the inside of the bend thereof with a longitudinally extending slit for passage therethrough of a sucked-in thread, comprising a pivot bearing for the pivotable suction tube, a negative pressure supply line connected to the suction tube at the pivot bearing, a transfer arm connected at one end thereof to the suction tube at the pivot bearing, and thread gripping means mounted for movement from the pivot bearing ot the free end of said transfer arm for transfering a thread end from the pivot bearing to the free end of the transfer arm.

The transfer arm serves for subsequently transfering the thread end to the withdrawal or delivery tube of the spinning chamber at the respective spinning stations of the open-end spinning machine.

In accordance with another feature of the invention, the thread gripping means is movable on a given path along the transfer arm, and the transfer arm is formed as a suction tube, the transfer arm being formed with a slit along the given path of movement of the thread gripping means.

In accordance with a further feature of the invention wherein the device for automaticaly joining the thread is in combination with a spinning station of the open-end spinning maching having a spinning chamber and a spun thread withdrawal tube extending therefrom, the free end of the transfer arm being pivotable to the vicinity of the withdrawal tube of the spinning chamber.

Transfer of the thread to the withdrawal or delivery tube of the spinning chamber is facilitated in accordance with an added feature of the invention, which includes a clamping device at the free end of the transfer arm for feeding a thread to the withdrawal tube of the spinning chamber, and a severing device at the free end of the transfer arm for severing a thread end received in either the transfer arm or the negative pressure line.

In accordance with an additional feature of the invention, the severing device comprises means for separating into fibers an end of the thread to be fed to the withdrawal tube of the spinning chamber.

In accordance with yet another feature of the invention, the severing device comprises a driven rollar having a roughened surface tangentially engageable with the thread to be severed.

After the transfer arm has been pivoted to the vicinity of the withdrawal or delivery tube of the spinning chamber, and the severing device has severed the thread and has plucked the fibers at the thread end to be fed thereto, the thread end, after loosening of the clamping device, can be sucked into the spinning chamber by means of the withdrawal or delivery tube. The quality of the joiner or piecer is dependent considerably on the length of the sucked-in thread. To make-ready this optimal thread length, there are provided in accordance with yet a further feature of the invention, means defining a path from the pivot bearing to the takeup coil, and means disposed in the path for storing the thread in adjustable lengths.

In accordance with an additional feature of the invention, the thread storing means comprises a loop-forming device including an encircling lever about which a thread loop is able to be disposed, the encircling lever, during loop-formation phase extending parallel to the longitudinal axis of the open-end spinning machine and, during loop-releasing phase, being pivotable in a direction toward the spinning station.

The amount of required suction air can be minimized, if there is provided, in accordance with another feature of the invention a rotary valve disposed at the pivot bearing for subjecting the bent suction tube to negative pressure when seizing the thread end located on the take-up coil, and for subjecting the transfer arm to negative pressure when transfering the thread end from the pivot bearing to the free end of the transfer arm.

The rotary valve can advantageously assume a double function when, in accordance with a concomitant feature of the invention, the rotary valve is formed with a thread guiding edge for simultaneously transfering the thread to within gripping range of the thread gripping means while turning the rotary valve.

The device according to the invention can be located at every spinning station of the spinning machine. It is more economical, however, to provide a common traveling joining or piecing device for several spinning stations. The number of thread breaks per unit of time that is to be expected, the maximal content of the fiber sliver containers or cans, and the fineness of the yarn or thread are contributory determining factors for the number of spinning stations with which a single traveling joining or piecing device according to the invention is to be associated.

Thus, a special advantage of the device of the invention is the achievement therewith of an accelerated, trouble-free automatic thread joining or piecing operation.

Other features which are considered as characteristic for the invention are set forth in the appended claims.

Although the invention is illustrated and described herein as embodied in a device for automatically joining a thread for spinning, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
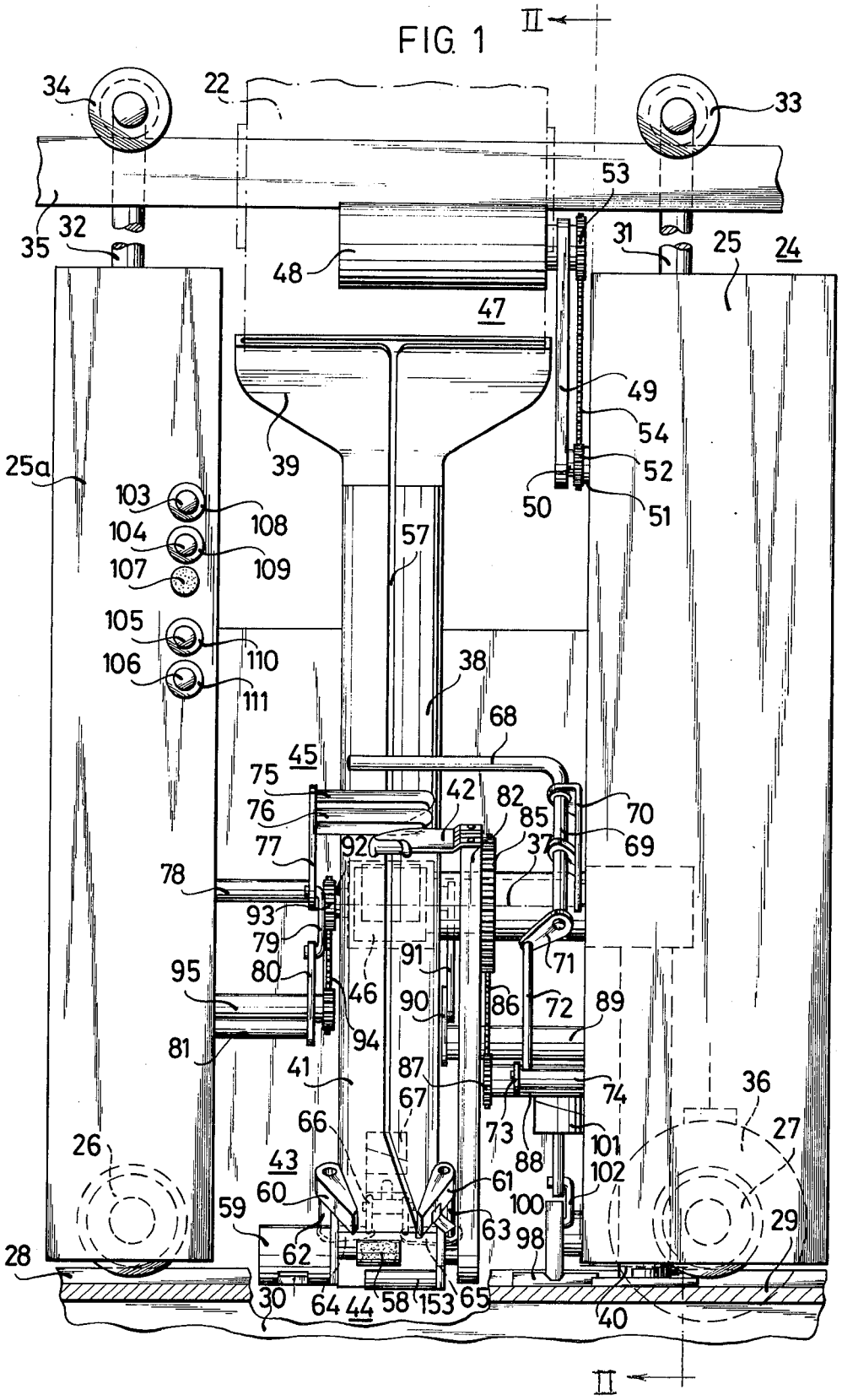
FIG. 1 is a front elevational view of the device for automatically joining a thread in a spinning operation according to the invention.

Referring now to the drawings and first, particularly, to FIGS. 2 to 6 thereof, there is shown a spinning station 11 of a spinning machine including a housing 12, a fiber sliver supply 13 being fed into the spinning station where the fibers of the sliver are loosened by a loosening roller 14 drivable by a motor M, a delivery, draw-off or withdrawal tube 15 of a non-illustrated spinning chamber from which spun thread 131 has been withdrawn by a withdrawal or delivery roller 16, a thread monitoring device 17, a thread conducting rod 18, a reciprocating thread guide 19, a take-up roller 20, a swiveling coil holder 21 with a take-up coil 22 secured thereon and an hydraulic damper 23 for the coil holder 21. All of the foregoing parts of the spinning station are conventional in the art and will therefore not be described in any further detail.

In FIG. 1 there is shown the device 24 for automatically joining or piecing a thread to institute or resume a spinning process in accordance with the invention. The device 24 has a bipartite housing 25, 25*a* and is capable of traveling on a rail 28 by means of rollers 26 and 27. The rail 28 is fastened on the housing 29 of a negative pressure channel 30 extending along the spinning machine. The housing halves 25 and 25*a* carry supports 31 and 32 to which guide rollers 33 and 34, respectively, are secured. The guide rollers 33 and 34 are rollably mounted on a rail 35 extending along the spinning machine. An electric motor 36 serves as the drive for the rollers 27 and various hereinafterdescribed movable parts of the device of the invention, the course of movement of which being preferably controlled by non-illustrated cam discs.

In FIGS. 1 to 6 there is seen on the device 24 according to the invention a suction tube 38 pivotable about a rotary axis 37, the suction tube 38 widening out upwardly to a suction nozzle 39. Also shown in FIGS. 1 to 6 are a negative pressure line 40 commmunicating with the negative pressure channel 30, a transfer arm 41, thread gripper 42, a clamping device 43, a severing device 44, a thread storage 45 and a rotary valve 46. In addition a reversal or retrace device 47 for the take-up coil 22 is shown. The reversal device 47 is formed of a reversing roller 48 which is rotatably secured to a swiveling lever 49 which is connected to a shaft 50. The shaft 50 is disposed coaxially to and within a hollow shaft 51. A gear 52 is mounted on the hollow shaft 51 and is connected by a toothed belt 54 to a gear 53 operatively associated with the reversing roller 48.

Figure 2:
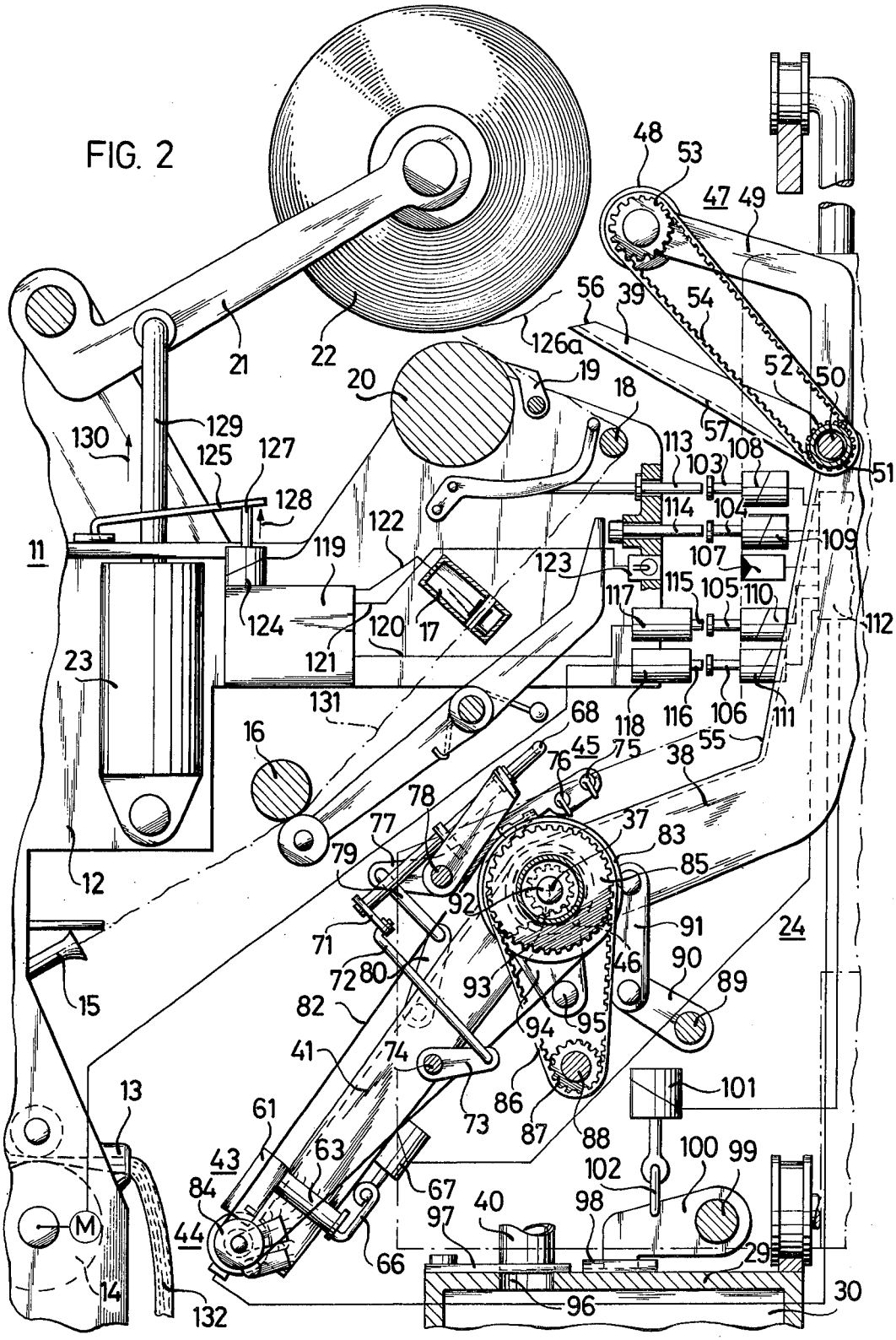
FIGS. 2 to 6 are sectional views of FIG. 1 taken along the line II—II in the direction of the arrows and showing the device of the invention in different phases of operation thereof.

The suction tube 38 is formed with a bend as seen in FIG. 2, for example, and is slotted along the inside 55 of the bend and the transfer arm 41 on the side thereof facing toward the spinning station 11, shown at the left-hand side of FIG. 2, for example. Thus, a continuous slit 57 extends from the mouth or orifice 56 of the suction nozzle 39 to the severing device 44.

The severing device 44 is formed of a roller 58, which is rotated rapidly by an electric motor 59 (FIG. 1). The surface of the roller 58 is roughened. The clamping device 43 has two clamping jaws 60 and 61. The clamping jaw 60 is seated at the end of a shaft 62, and the clamping jaw 61 at the end of a shaft 63. The shaft 62 is connected to a lever 64, and the shaft 63 to a lever 65. The levers 46 and 65 are articulatingly connected to a linkage 66 so that they can be actuated in opposing direction by the linkage 66. Acutation is effected through an electromagnetic drive 67 connected to the linkage 66. By means of this electromagnetic drive 67, the clamping device 43 can thereby be opened or closed.

The thread storage device 45 is constructed as a multipartite loopformer. It includes an encircling or looping lever 68 which, in normal setting thereof, extends parallel to the longitudinal axis of the open-end spinning machine. The lever 68 has an end 69 extending angularly therefrom and mounted in a bearing block 70 and connected to a lever 71. The lever 71 is articulatingly connected by a rod 72 to another lever 73 which is seated at an end of a shaft 74. The thread storage device 45 additionally includes two encircling or looping pins 75 and 76 which are fastened to a bellcrank 77 that is rotatably mounted on a pin 78. The bellcrank 77 is articulatingly connected by a rod 79 to a lever 80 which is, in turn, fastened to a shaft 81.

The thread gripper 42 is secured to a drive belt 82 which is slung about a belt pulley 83 disposed coaxially to the rotary axis 37 and about another belt pulley 84 rotatably mounted at the end of the transfer arm 41. A gear 85 is connected to the belt pulley 83 and, through a toothed belt 86, to another gear 87. The gear 87 is seated at the end of a shaft 88.

The suction tube 38 and the transfer arm 41 are firmly connected one to the other. They can both be swung together about the rotary axis 37 by means of a lever 90 fastened to a shaft 89 and articulatingly connected by a strap 91 to the wall of the suction tube 38.

The rotary valve 46 has a shaft 92 extending through the wall of the suction tube 38 and carrying a gear 93 at the end thereof. A toothed segment 94 meshing with the gear 93 is fastened to a shaft 95.

The housing 29 of the negative pressure channel 30 is formed with an opening in front of each spinning station. One of the openings 96 is visible in FIGS. 2 to 6 and is closable by a flap 97 which is spring-biased to a side in closed position thereof. The end of the negative pressure line 40 has shifted the flap 97 to the side whereby the negative pressure line 40 has become connected to the negative pressure channel 30.

On the housing 29, a lock or detent is disposed in front of each spinning station. In the figures of the drawing, the detent or lock 98 associated with the spinning station 11 is visible. A pawl 100 of the device 24 pivotable about a shaft 99 is engaged in the detent 98. The pawl 100 is actuatable by an electromagnetic drive 101, which is connected by a linkage 102 to the pawl 100.

In the upper part of the housing 25*a* of the device 24 of the invention, as viewed in the figures, plungers 103 and 106 and a photoelectric element 107 are mounted. Respective electromagnetic drive 108 to 111 are operatively associated with the plungers 103 to 106. All of the electromagnetic drives 108 to 111 and the photoelectric element 107 are connected by lines to suitable conventional electric switch gear 12.

In the wall of the housing 12 of the spinning station 11, actuating elements 113 to 116 in the form of additional plungers are respectively disposed in alignment with the plungers 103 and 106. The plunger 115 actuates an electric switch 117, and the plunger 116 an electric switch 118.

The spinning station 11 also has its own small switch gear 119 which is connected through respective lines 120, 121 and 122 to the switch 117, to an electric light source 123 disposed in front of and in alignement with the photoelectric cell 107 and to the thread monitoring device 17. Furthermore, a connection exists between the switch gear 119 and an electromagnetic drive 128 of a lifting or stroke mechanism 125.

With respect to FIGS. 2 to 6, the thread joining operation, fragmented or analyzed in individual phases of motion thereof, is described hereinafter.

According to FIG. 2, the device 24 of the invention has just clicked into position in front of the spinning station 11. It is assumed that the spun thread is broken. The switch gear 119 has accordingly switched on the electric light source 123 through the line 121. The photoelectric cell 107 of the device 24 just traveling past the spinning station 11 has intercepted the light rays emanating from the light source 123 and has transmitted an electric signal to the switchgear 112 which, upon receiving this signal has caused the engagement of the pawl 100 in the detent 98. The thread end 126*a* has run up on the take-up coil 22. The plunger 127 of the electromagnetic drive 124 has been driven out in direction of the arrow 128. The lifting or stroke mechanism 125 has lifted the rod 129 of the hydraulic damper 23 in direction of the arrow 130 whereby the take-up coil 22 has been lifted away from the winding roller 20. The travel path of the thread of the previously existing undisturbed operation is indicated by the dot-dash line 131. The fiber loosening roller 14 is already stationary and the fiber sliver 132 is not being fed any further.

Figure 3:
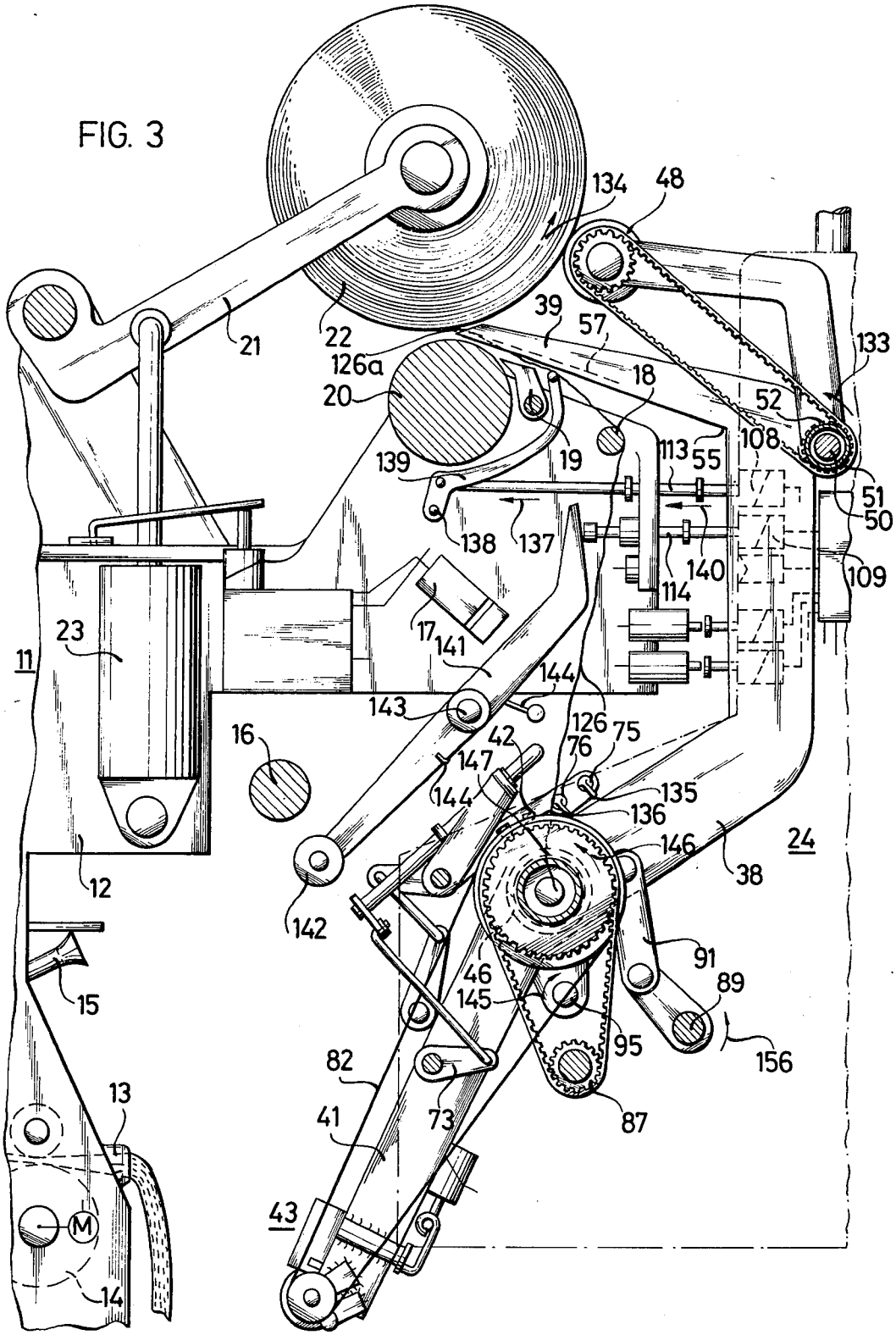

With the engagement or "clicking-in" of the device 24, the switchgear 112 initiates the operation of a non-illustrated programmed switchgear, the specific construction of which is immaterial and may be of any conventional design as long as it causes the following actions sequentially:

According to FIG. 3, the shaft 50 is rotated in direction of the arrow 133 until the reversing roller 48 comes into contact with the take-up coil 22. Simultaneously, the hollow shaft 51 and, therewith also the gear 52, is rotated in a direction opposite that of the arrow 133 whereby the take-up coil 22 is rotated slowly by means of the reversing roller 48 in direction of the arrow 134 opposite the winding direction. During the initial engagement or "clicking-in" of the device 24 of the invention, as the rotary valve 45 stood in the position shown in FIG. 2, the suction tube 38 was already subjected to negative pressure through the negative pressure line 40 and the rotary valve 46. The instant the suction nozzle 39 has seized the thread end 126*a*, it is sucked in trough the suction tube 38 until it extends into the negative pressure line 40. Since the suction tube 38 is slit at the inner side 55 of the bend thereof, the thread 126 sucked away from the take-up coil 22 finally emerges from the slit 57, slides over the rounded rear parts 135 and 136 of the encircling pins 75 and 76 and deposits against the thread conducting rod 18 and the front side of the encircling pin 76.

The electromagnetic drive 108 was actuated beforehand so that the plunger 113 travels in direction of the arrow 137, and a thread lifter 139 pivotable about the shaft 138 is lifted so high that the thread 126 cannot reach the thread guide 19 that continues to operate further. The electromagnetic drive 109 is then actuated whereby the plunger 114 is displaced in direction of the arrow 140 and presses against the end of one arm of a two-armed lever 141, on the other arm of which a pressure roller 142 is rotatably secured. The two armed lever 141 is pivotable about a shaft 143 and subjected to loading by a return spring 144. The pressure roller 142 moves away from the further-rotating withdrawal or delivery roller 16 during movement of the lever 141. In the interim, the shaft 95 is rotated in direction of the arrow 145, the rotary valve 46 being shifted in direction of the arrow 146 through the toothed segment 94 and the gear 93. The rotary valve 46 has a thread guiding edge 147 which, according to FIG. 3, comes into contact with and guides the thread 126.

Figure 4:
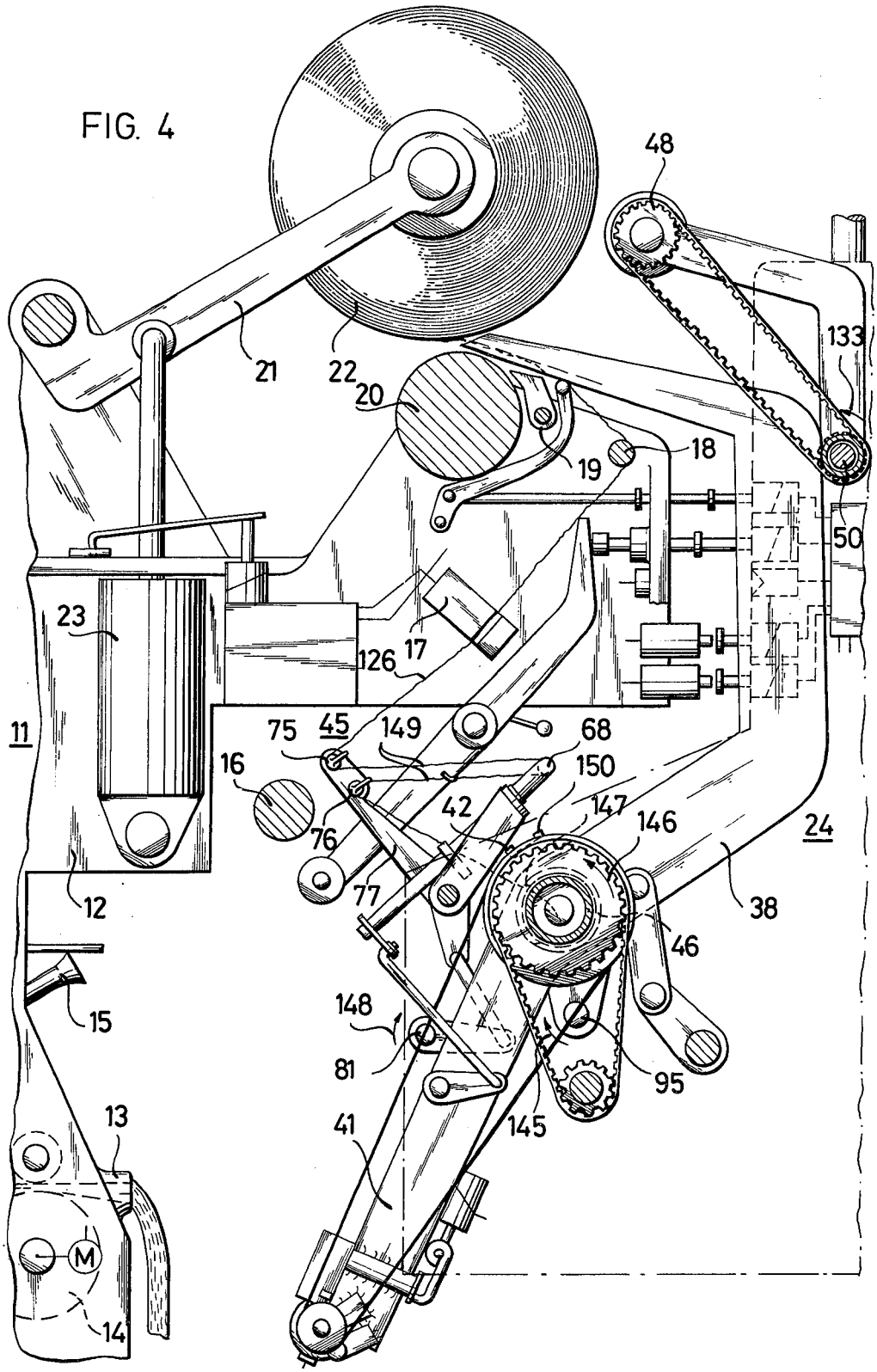

According to FIG. 4, the shaft 50 is then turned back opposite to the direction of the arrow 133 so that the reversing roller 48 loses contact with the take-up coil 22 because no further thread length is to be withdrawn any more from the take-up coil 22. Simultaneously, the thread storage device 45 is actuated. The shaft 81 is rotated in direction of the arrow 148 causing the bellcrank 77 to swing out into the position thereof shown in FIG. 4. An elongated thread loop 149 is thereby formed between the encircling lever 68 and the encircling pins 75 and 76. In the interim, the shaft 95 has been rotated even further in direction of the arrow 145, and the rotary valve 46 has thereby been shifted even further in direction of the arrow 146, whereby the suction tube 38 has already been shut off from the negative pressure line 40 and, consequently, the transfer arm 41 has been connected to the negative-pressure line 40.

Figures 5, 7:
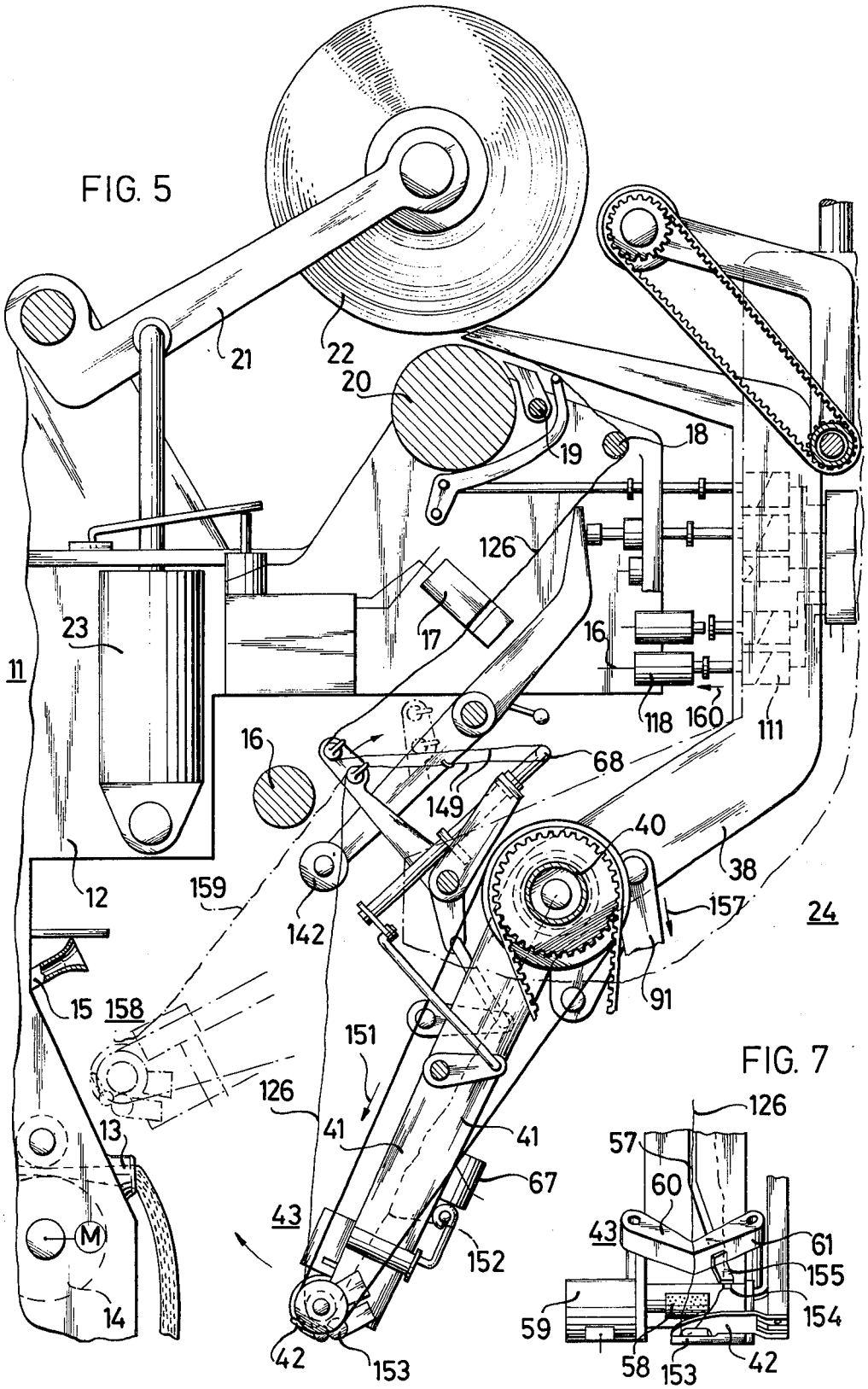
FIG. 7 is a fragmentary view of FIG. 1 in another phase of the operation of the clamping and severing device forming part of the device of the invention.

During the movement of the bellcrank 77, the thread 126 becomes stretched in a straight line between the encircling pin 76 and the thread guiding edge 147 of the rotary valve 46, the thread 126 sliding over the rounded rear 150 of the thread gripper 42 until it is in front of the thread gripper 42. If the thread gripper 42, in accordance with FIG. 5, then is transported in direction of the arrow 151 forwards to the end of the transfer arm 41, it entrains the thread 126. The required thread length is withdrawn from the negative pressure line 40. The thread 126 thereby reaches the vicinity of the clamping device 43 which closes after actuation of the electromagnetic drive 67 as shown in FIG. 7. From FIG. 7 it is also apparent that the slit 57 extends to the side slightly at an angle near the end thereof. This angle formation is necessary so that the thread 126 is not severed at two locations thereof but rather only at one location by the continuously rotating roller 58. The thread end 152 projecting into the transfer arm 41 should not be severed but should rather remain clamped initially between the thread gripper 42 and a rubber cushion 153 located at the transfer arm 41. Only when closing the clamping jaws 60 and 61 is the thread 126 brought into contact with the roller 58 and only then does there begin the severing of the thread and simultaneous unraveling or separation into fibers of the thread end that is to be newly produced and later used for joining to begin the spinning operation. In order that this thread end should not be able to slide in the slit 57, the slit end 154 is covered by a patch or flap 155 fastened to the clamping jaw 61.

Then, the moving phase of the transfer arm 41 begins. According to FIG. 3, the shaft 89 is thus rotated in direction of the arrow 156 which, in accordance with FIG. 5, causes a movement of the strap 91 in direction of the arrow 157. The transfer arm 41 thereby swings initially into the position 158 thereof shown in phantom in FIG. 5, and finally into the solid-line position thereof shown in FIG. 6. The instant the transfer arm 41 has reached the position 158 thereof shown in phantom in FIG. 5, the thread 126 is located between the withdrawal or delivery roller 16 and the pressure roller 142. Rounded edges of the pressure roller 142 facilitate the guidance of the thread in the position 159 thereof shown in phantom in FIG. 5.

Figure 6:
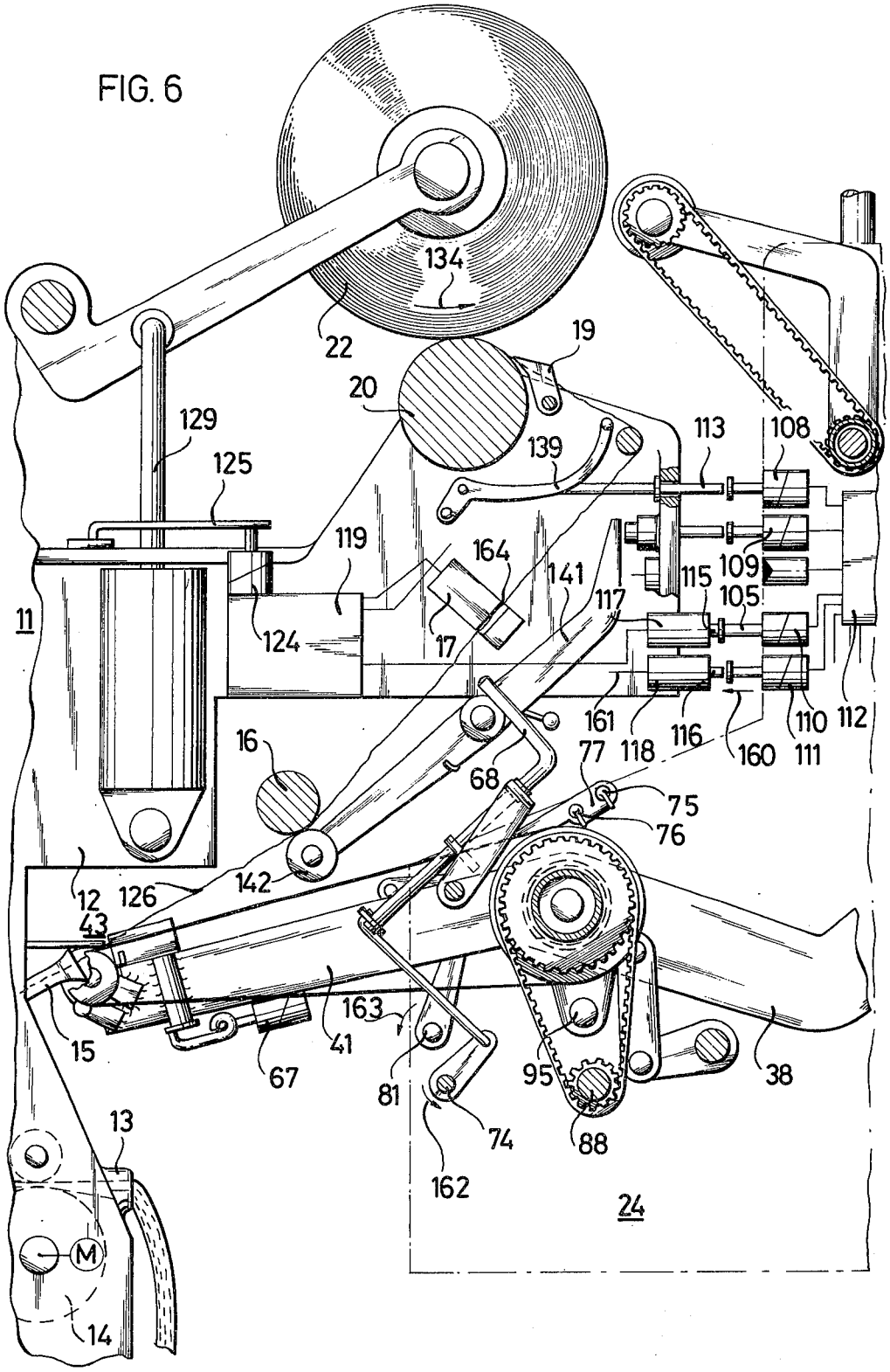

The instant the transfer arm 41 has reached the position thereof shown in FIG. 6, the electromagnetic drive 111 is initially switched on, the plunger 116 being displaced in direction of the arrow 160. By means of the plunger 116, the switch 118 connected to the motor M is accordingly switched on through a line 161, so that the motor M sets the fiber-loosening roller 14 into operation. Simultaneously, the non-illustrated rotor of the spinning station 11 is also switched on again through the switch 118 so that, with the start-up of the rotation of the non-illustrated spinning rotor negative pressure is produced in the non-illustrated spinning chamber and, therewith, also in the withdrawal or delivery tube 15. The electromagnetic drive 67 is then also switched off again, whereupon, the clamping jaws 60 and 61 of the clamping device 43 open due to spring force and free the thread 126 to be subjected to suction. Simultaneously, the shaft 74 is rotated in direction of the arrow 162, the encircling lever 68 turning so far that it extends in direction toward the spinning station 11, as shown in FIG. 6. The thread reserve, which previously existed in the form of the thread loop 149 is thereby freed or released.

Since negative pressure prevails in the withdrawal or delivery tube 15, the end of the thread 126 is sucked into the tube 15 up to the non-illustrated spinning rotor of the spinning station 11, whereat the thread joining per se occurs through the application of loose fibers to the thread end. At the moment joining takes place, a tugging signal is produced on the thread 126. This tugging signal can readily be sensed by conventional non-illustrated means and, after conversion to an electric signal, transmitted to the switchgear 112. At the instant joining takes place, the thread 126 should again be withdrawn from the withdrawal or delivery tube 15. The detected tugging signal provides a possibility of communicating to the switchgear 112 the instant of thread joining. At the instant joining occurs, the switchgear 112 causes the following switching operations: the electromagnetic drive 109 is switched off which results in the swinging back of the lever 141 to the starting positon thereof and, therewith, the spring-loaded application of pressure by the pressure roller 142 against the thread 126 and simultaneously against the withdrawal or delivery roller 16 which continues to rotate. The shaft 81 is turned so far in direction of the arrow 163 until the bellcrank 77 assumes the position thereof shown in FIG. 6. The encircling pins 75 and 76 can then no longer obstruct the thread 126.

The electromagnetic drive 110 is switched on, the plunger 105 actuating the plunger 115 of the switch 117. The switch 117 causes the switchgear 119 to switch off the electromagnetic drive 124 and to effect a delayed switching-on of the thread monitor 17. The electromagnetic drive 124 is switched off so that the lifting device 125 is again released from the rod 129, whereby the take-up coil 22 makes contact with the winding roller 20 which continues to rotate and the take-up coil 22 begins to rotate in winding direction opposite to the direction of the arrow 134. The thread monitor 17 is switched on only when the take-up coil 22 has wound up the thread 126 so far and so tightly that the thread 126 has come to lie in the thread guide 164 of the thread monitor 17. The electromagnetic drive 108 is switched off so that the plunger 113 is freed again and the thread lifter 139 can fall into the starting position thereof. The thread 126 then slides into the thread guide 19 and, thereby the spinning station 11 is again shifted or converted to normal operation. Finally, through the rotation of the shaft 88 of the thread gripper 42 and through rotation of the shaft 95, the suction tube 38 and, simultaneously, also the transfer arm 41 are brought into the starting positions thereof shown in FIG. 2. The device 24 of the invention then receives the command through the switchgear 112 to travel on. For this purpose, the electromagnetic drive 101 is initially switched on which draws the pawl 100 out of the detent 98. Then the roller 27 is set in motion through the electric motor 36.

There are claimed:

1. Device for automatically joining a thread for spinning in an open-end spinning maching having a pivotable bent suction tube for seizing a thread end located on a take-up coil, the suction tube being formed at the inside of the bend thereof with a longitudinally extending slit for passage therethrough of a sucked-in thread, comprising a pivot bearing for the pivotable suction tube, a negative pressure supply line connected to the suction tube at said pivot bearing, a transfer arm connected at one end thereof to the suction tube at said pivot bearing, and thread gripping means mounted for movement from said pivot bearing to the free end of said transfer arm for transfering a thread end from said pivot bearing to said free end of said transfer arm.

2. Device according to claim 1 wherein said thread gripping means is movable on a given path along said transfer arm, and wherein said transfer arm is formed as a suction tube, said transfer arm being formed with a slit along the given path of movement of said thread gripping means.

3. Device according to claim 1 in combination with a spinning station of the open-end spinning machine having a spinning chamber and a spun thread withdrawal tube extending therefrom, the free end of said transfer arm being pivotable to the vicinity of the withdrawal tube of the spinning chamber.

4. Device according to claim 3 including a clamping device at said free end of said transfer arm for feeding a thread to the withdrawal tube of the spinning chamber, and a severing device at said free end of said transfer arm for severing a thread received in one of said transfer arms and said negative pressure line.

5. Device according to claim 4 wherein said severing device comprises means for separating into fibers an end of the thread to be fed to the withdrawal tube of the spinning chamber.

6. Device according to claim 5 wherein said severing device comprises a driven roller having a roughened surface tangentially engageable with the thread to be severed.

7. Device according to claim 1 including means defining a path from said pivot bearing to the take-up coil, and means disposed in said path for storing the thread in adjustable lengths.

8. Device according to claim 7 wherein said thread storing means comprises a loop-forming device includng an encircling lever about which a thread loop is able to be disposed, said encircling lever, during loop-formation phase extending parallel to the longitudinal axis of the open-end spinning machine and, during loop-releasing phase being pivotable in a direction toward the spinning station.

9. Device according to claim 2, including a rotary valve disposed at said pivot bearing for subjecting said bent suction tube to negative pressure when seizing the thread end located on the take-up coil, and for subjecting said transfer arm to negative pressure when transfering the thread end from said pivot bearing to said free end of said transfer arm.

10. Device according to claim 9 wherein said rotary valve is formed with a thread guiding edge for simultaneously transfering the thread to within gripping range of said thread gripping means while turning said rotary valve.

* * * * *